US007527508B1

(12) United States Patent
Lee et al.

(10) Patent No.: US 7,527,508 B1
(45) Date of Patent: May 5, 2009

(54) SLIDING SAFETY STRUCTURE FOR POWER SUPPLY RECEPTACLES

(75) Inventors: Chiu-San Lee, Taipei (TW); Yi-Hsun Lee, Taipei (TW)

(73) Assignee: XYZ Science Co., Ltd., Taipei City (TW)

( * ) Notice: Subject to any disclaimer, the term of this patent is extended or adjusted under 35 U.S.C. 154(b) by 0 days.

(21) Appl. No.: 12/169,313

(22) Filed: Jul. 8, 2008

(51) Int. Cl.
*H01R 13/44* (2006.01)

(52) U.S. Cl. ..... 439/137

(58) Field of Classification Search ..... 439/135–138, 439/535

See application file for complete search history.

(56) References Cited

U.S. PATENT DOCUMENTS 7,144,261 B2 * 12/2006 Merlet ..... 439/136
7,445,472 B1 * 11/2008 Huang et al. ..... 439/138

FOREIGN PATENT DOCUMENTS

TW 337384 7/1998
TW M249294 11/2004
TW M312819 5/2007

* cited by examiner

*Primary Examiner*—Khiem Nguyen
(74) *Attorney, Agent, or Firm*—Muncy, Geissler, Olds & Lowe, PLLC

(57) ABSTRACT

A sliding safety structure for power supply receptacles located on a path of a plug prong inserting to a receptacle electrode includes a control dock which has a directing stem, a safety gate slidably located on the directing stem and an elastic element which has two ends pushing respectively the control dock and the safety gate. The safety gate has two force receiving portions which are pushed by the elastic element in regular conditions to block the path of the plug prong inserting to the receptacle electrode and maintain at a latched position. When the plug prong is inserted into the receptacle, the two force receiving portions are depressed by the plug prong to move the safety gate to slide away from the latched position so that insertion of the plug prong to the electrode of the power supply receptacle is allowed. The safety gate also has a stopper below the sliding path thereof to harness the safety gate at the latched position when the two force receiving portions receive uneven forces. Thus an enhanced safety effect can be accomplished to improve the disadvantage occurred to the conventional safety structure which is openable when subject to a force at one side.

16 Claims, 10 Drawing Sheets

SLIDING SAFETY STRUCTURE FOR POWER SUPPLY RECEPTACLES

FIELD OF THE INVENTION

The present invention relates to a sliding safety structure and particularly to a safety structure adopted for using on power supply receptacles.

BACKGROUND OF THE INVENTION

Electric power is a convenient and steady energy source for modern households. Due to electricity is invisible to human eyes, electric shock or leakage resulted from users' negligence could cause hazards to people' life or property damage. This concern is especially serious for houses which have babies or small children. Hence safety use of electric power is an important issue that needs more attention. Most houses have power supply receptacles installed on lower locations of the walls. Children often have a great curiosity and try to insert metallic articles into the receptacles that are electric power-enabled. It is a dangerous action that has to be guarded against constantly.

To prevent the risky situation mentioned above from happening, some techniques have been proposed. For instance, R.O.C. patent Nos. M312819, M249294 and 337384 disclose a protection means for safety receptacles with a safety gate to prevent electric shock. M312819 and M249294 have a detent plate located between receptacle slots and electrodes. The detent plate is pushed by a spring in regular conditions and located beneath the slots. When a plug is inserted into the slots the detent plate is moved so that the plug prongs and the receptacle electrodes can be connected. Although in M312819 and M249294 the detent plate blocks the slots of the receptacle, when in use the detent plate can be moved away by inserting one slot forcefully to expose another slot. Hence protection effect is compromised.

Patent No. 337384 provides a universal safety receptacle and plug. The receptacle has a control seat and a safety detent plate that are interposed by a spring which provides a push force so that the safety detent plate is maintained at a lower side of the slots of the receptacle in regular conditions. The safety detent plate has an inclined top surface. When the plug is inserted into the slots the detent plate is pushed and moved. The safety detent plate also has a flange at the top surface and the control seat has a notch on the top surface thereof corresponding to the flange. In the event that the safety detent plate is subject to a force from one side or unevenly, and results in a biased movement to the left side or right side, the flange is moved upwards to latch the notch so that detent plate is hindered from moving rearwards. While such a latch structure in Patent No. 337384 can prevent the safety detent plate from being moved away by an one side or uneven force, the latch relationship between the flange and notch cannot withstand too much of applying force, or movement of the safety detent plate still could happen and result in compromising of safety protection. Therefore, Patent No. 337384 can not provide safe measures efficiently.

SUMMARY OF THE INVENTION

The primary object of the present invention is to solve the aforesaid disadvantages by providing a safety structure for power supply receptacles that has a detent plate located in a receptacle to block slots thereof and remains at a lower side of the slots even if it is subject to a one side or uneven force.

To achieve the foregoing object the safety structure of the invention is located on a path where a plug prong is inserted to an electrode of a power supply receptacle. It includes a control dock located on a loading surface of the power supply receptacle that has a direction stem, a safety gate slidably coupled on the directing stem and an elastic element with one end pushing the control dock and another end pushing the safety gate. The safety gate is pushed by the elastic element to a latched position in regular conditions and has two force receiving portions in the latched position to block the plug prong from inserting the path of the electrode of the receptacle. When the plug prong is inserted into the receptacle the two force receiving portions also are being pushed such that the safety gate slides away from the latched position, and the plug prong can be inserted to connect the electrode of the power supply receptacle. There is a stopper at a lower side of the sliding path of the safety gate to harness the safety gate at the latched position when the two force receiving portions receive uneven forces The structure thus formed can provide enhanced safety protection for the power supply receptacle.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
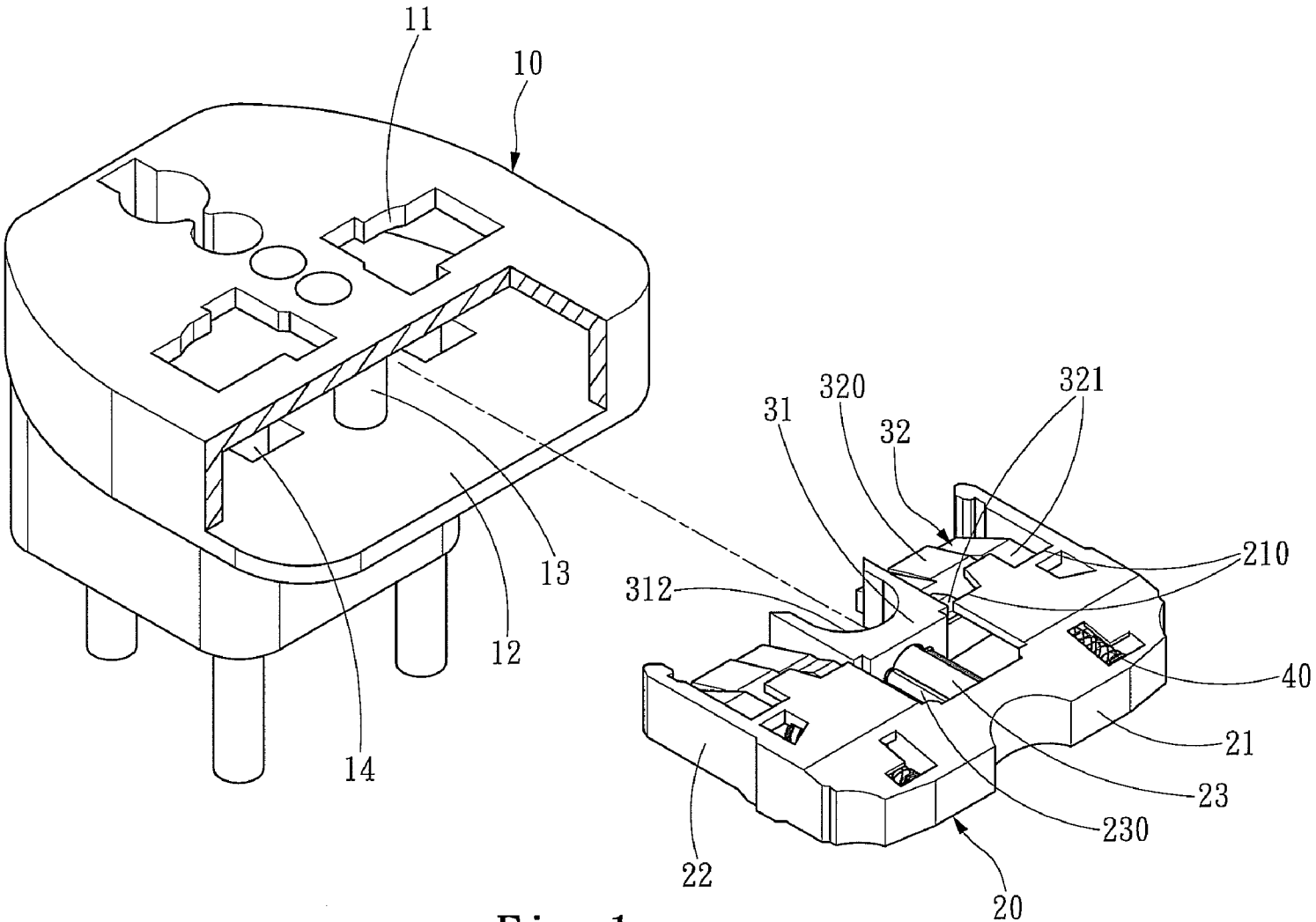
FIG. 1 is a schematic view of an embodiment of the invention.
Figure 2A:
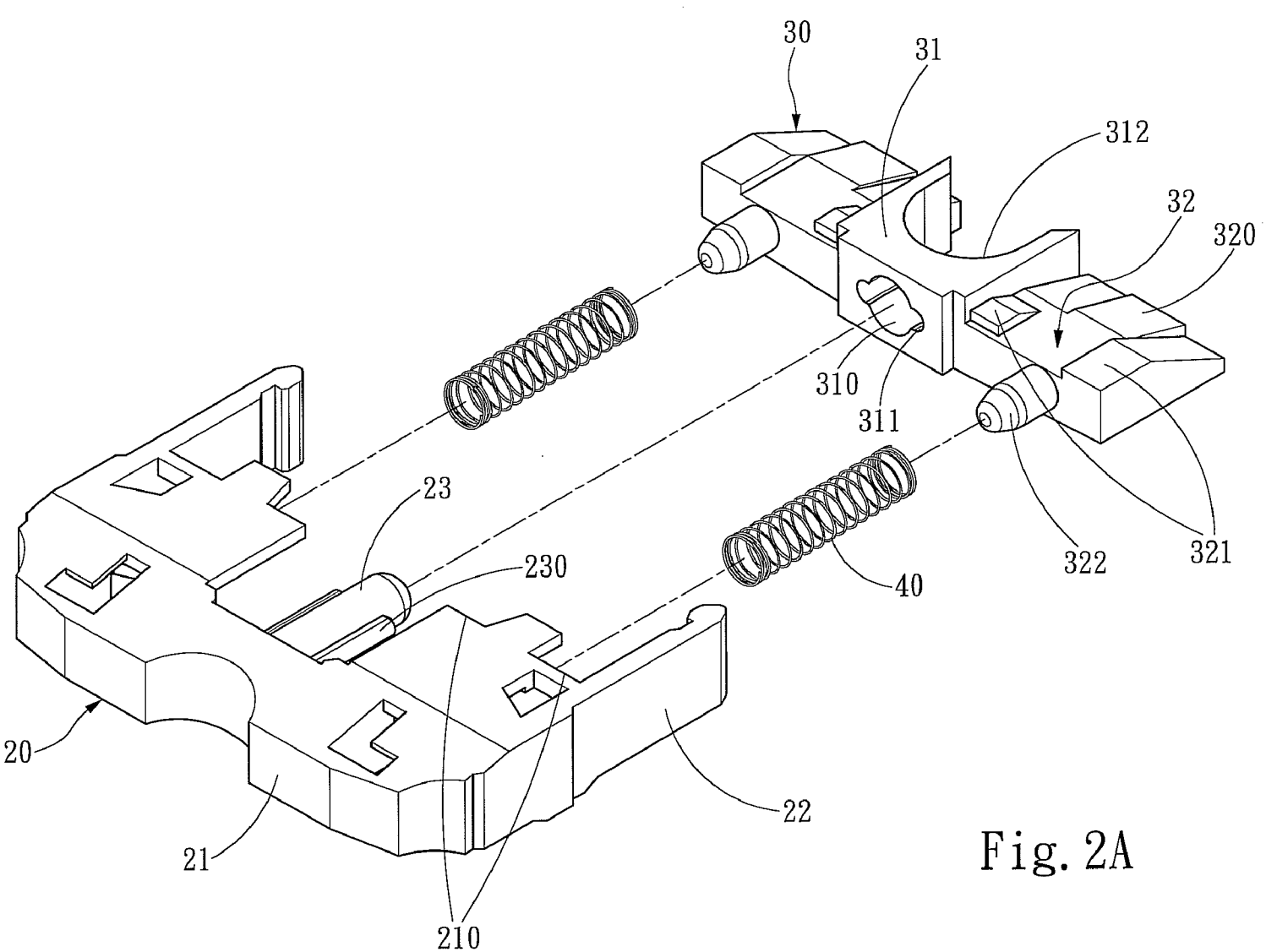
FIGS. 2A and 2B are exploded views of a first embodiment of the invention.
Figure 2B:
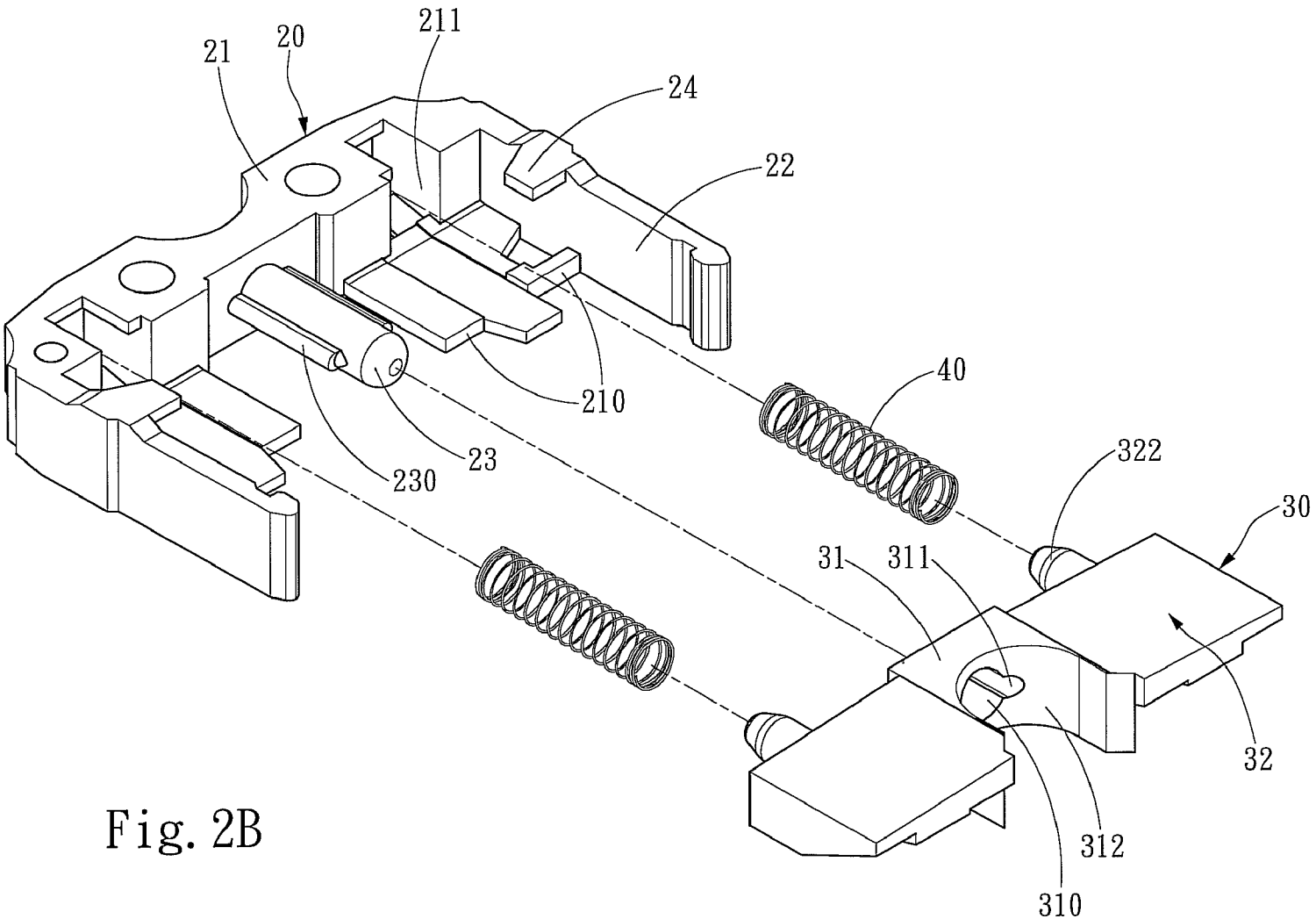
Figure 3A:
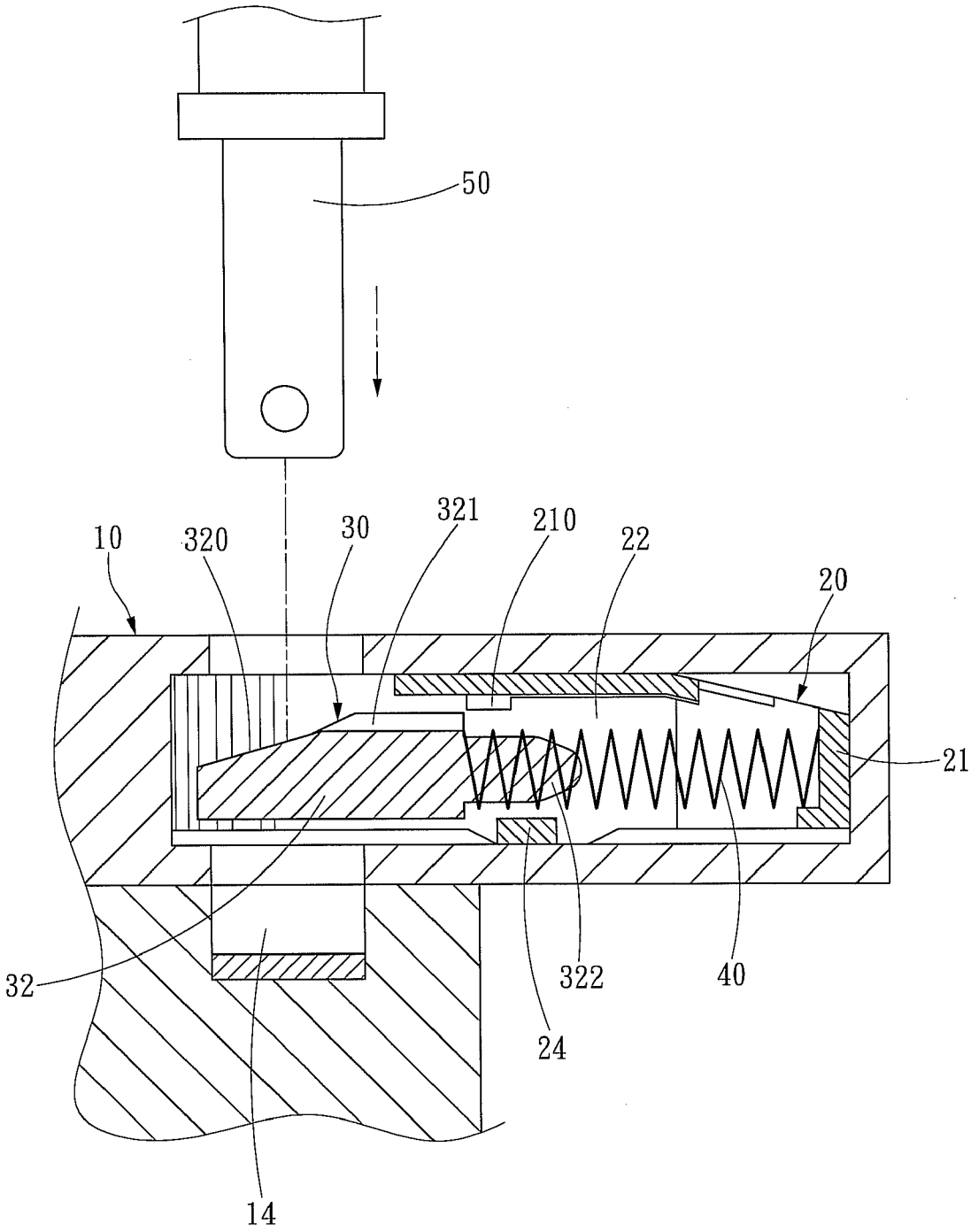
FIGS. 3A to 3C are schematic views of the invention in operating conditions.

Please referring to FIGS. 1, 2A and 2B, the sliding safety structure for power supply receptacles according to the invention is located on an insertion path of a plug prong 50 (as shown in FIG. 3A) inserting to a receptacle electrode 14. It mainly includes a control dock 20 located on a loading surface 12 in a power supply receptacle 10 and a safety gate 30. The control dock 20 and the safety gate 30 are pushed by two ends of an elastic element 40 interposed between them. The control dock 20 has a base 21 and two bracing arms 22 at two sides of the base 21, and the base 21 has a directing stem 23 located between the two bracing arms 22. The safety gate 30 has a sliding portion 31 with a directing hole 310 formed thereon to be slidably coupled on the directing stem 23. The directing stem 23 and the directing hole 310 have respectively a directing flange 230 and a directing trough 311 corresponding to each other to increase the loading capability of the directing stem 23, and also prevent the safety gate 30 from turning in a biased manner during sliding and provide sliding smoothness. The sliding portion 31 has a bracing surface 312 at one side. The safety gate 30 is pushed by the elastic element 40 in regular conditions so that the bracing surface 312 presses a bracing strut 13 located in the power supply receptacle 10 at a latched position on the directing stem 23. The safety gate 30 also has two force receiving portions 32 to block the plug prong 50 from being inserted to the path of the receptacle electrode 14 at the latched position. Each of the force receiving portions 32 has an inclined surface 320 which can receive a depressing force to move the safety gate 30 to slide on the directing stem 23 away from the latched position. The safety gate 30 further has a stopper 24 below the sliding path of the safety gate 30. When one of the inclined surfaces 320 of the safety gate 30 receives a force and turns in a biased manner, the stopper 24 is latched on the force receiving portions 32 to form a retaining relationship so that the safety gate 30 cannot slide and is maintained at the latched position. In addition, on the sliding path of safety gate 30, the control dock 20 and the force receiving portions 32 also have respectively an ancillary stopper 210 and 321 that are latchable with each other while the inclined surface 320 receives the force to increase the retaining effect. Moreover, the directing stem 23 is formed at a length greater than the directing flange 230 so that when the safety gate 30 is at the latched position and receives a force at one side or an uneven force, and results in a biased turning and causes the directing trough 311 not able to be aligned with the directing trough 230, the safety gate 30 cannot slide on the directing stem 23. Thus in the event that the inclined surface 320 receives a force the safety gate 30 does not escape from the latched position. As shown in the drawings, the stopper 24 is a lug located at the bottom of the control dock 20 and the bracing arm 22. The elastic element 40 has one end coupled on a coupling strut 322 located on the force receiving portion 32 and other end anchored on an anchor notch 211 formed on the control dock 20.

Figure 3B:
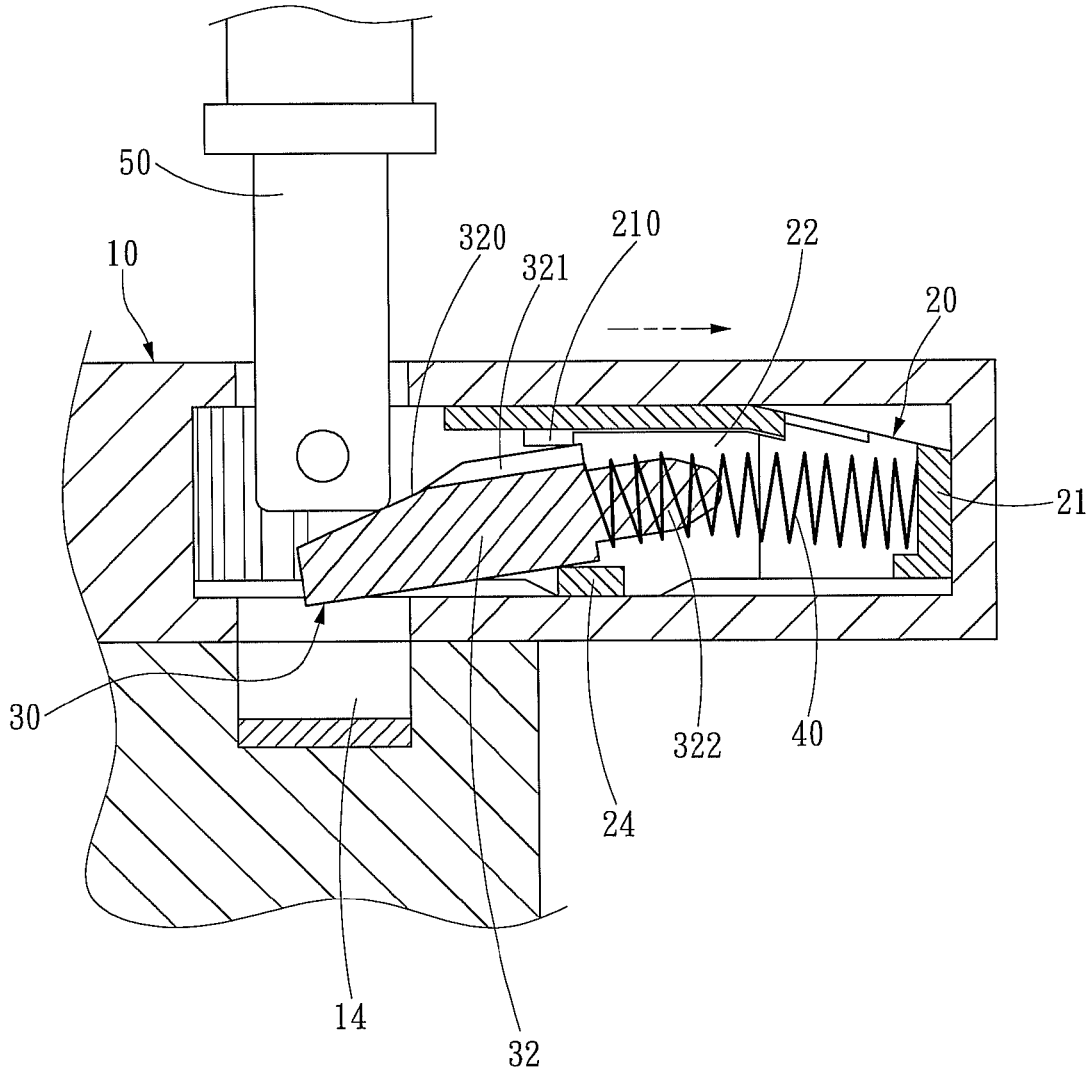
Figure 3C:
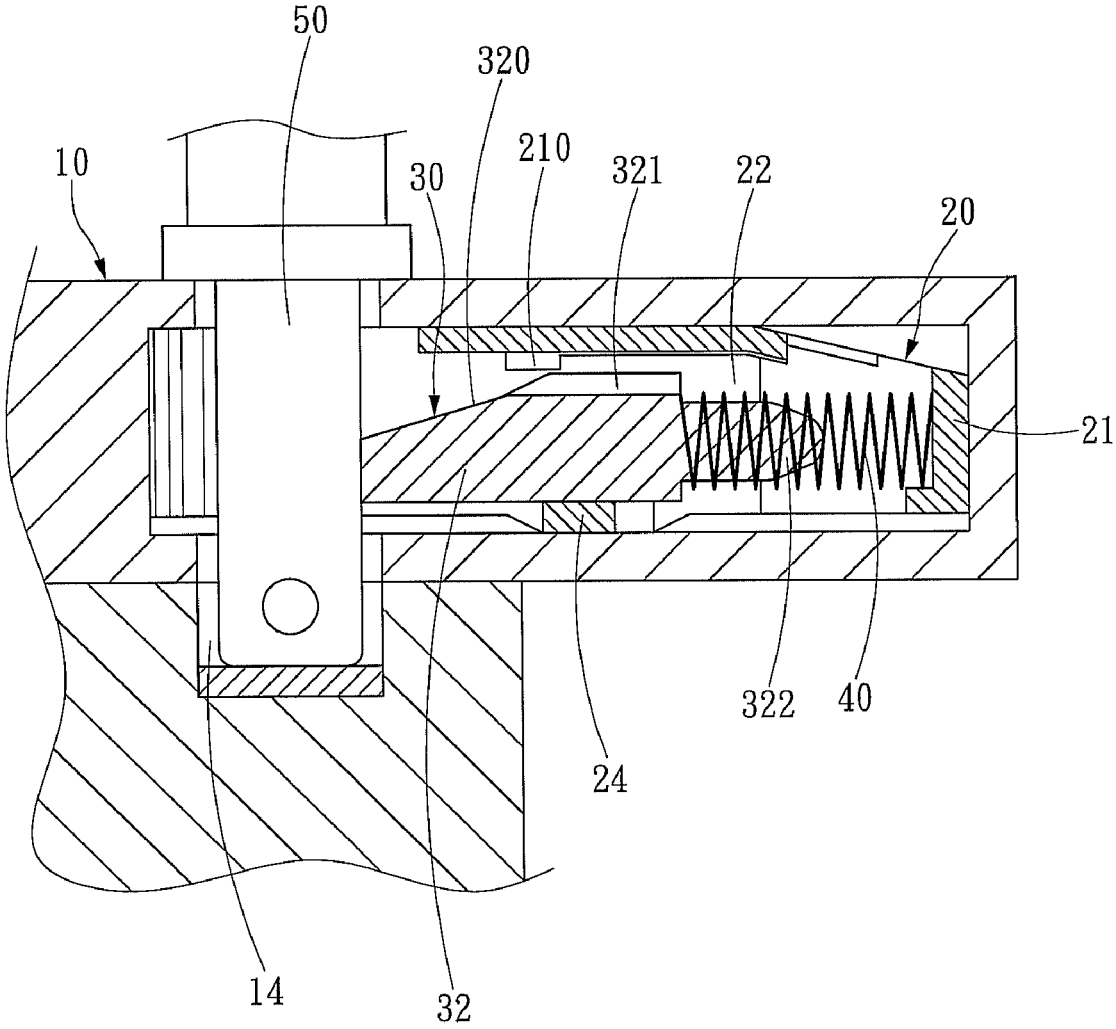
Figure 4:
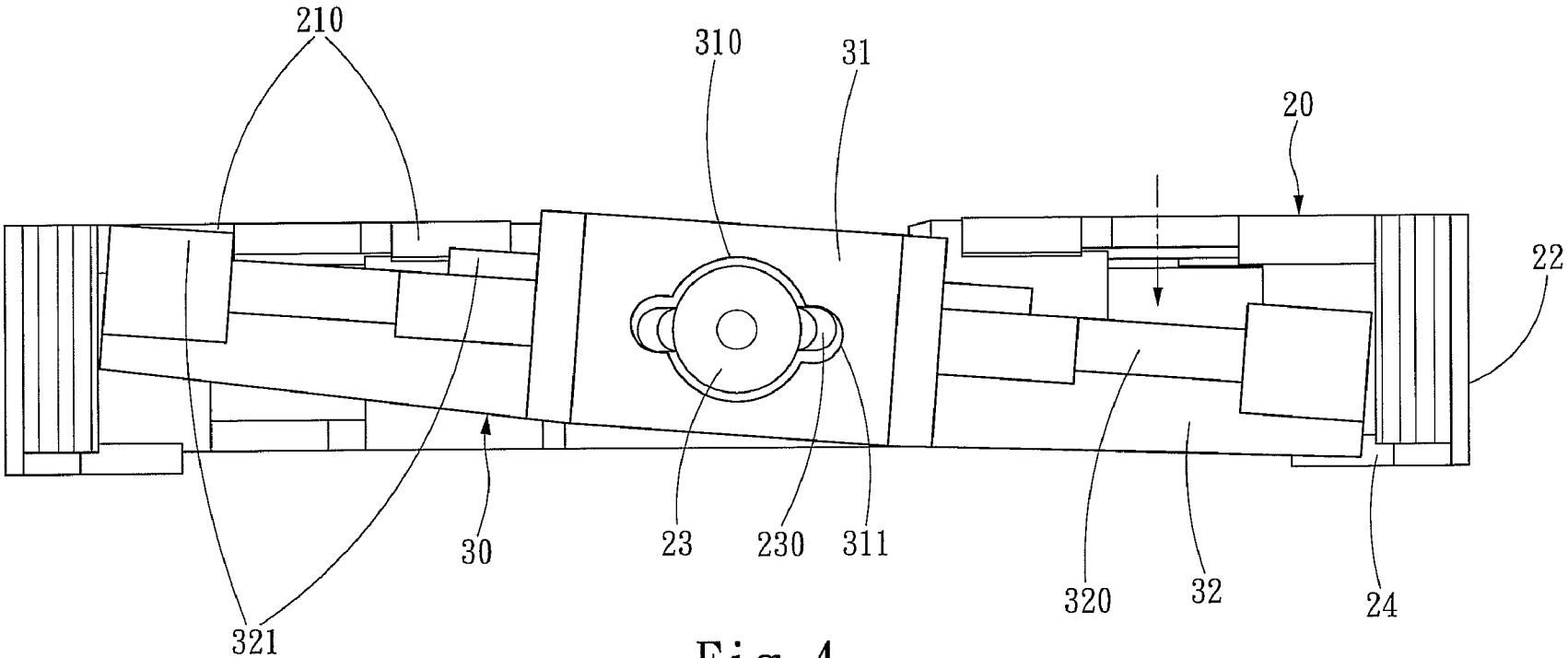
FIG. 4 is a schematic view of the safety gate in a condition of receiving a force at one side.

Referring to FIGS. 3A, 3B and 3C, when in use, before the plug prong 50 is inserted into the receptacle initially, the safety gate 30 is pushed by the elastic element 40 at the latched position (referring to FIG. 3A); after the plug prong 50 is inserted into a slot 11 of the power supply receptacle 10 and depresses the inclined surface 320 of the force receiving portions 32, the safety gate 30 inclines slightly; due to the ancillary stopper 210 of the control dock 20 and the stopper 24 are located at different perpendicular locations, the safety gate 30 slides towards the control dock 20 and compresses the elastic element 40 (referring to FIG. 3B) until the safety gate 30 continuously slides and escapes the latched position, then the plug prong 50 is inserted to the receptacle electrode 14 to form a circuit (referring to FIG. 3C). As sliding movement can be generated only when the two inclined surfaces 320 of the two force receiving portions 32 receive forces at the same time, as shown in FIG. 4, when only one inclined surface 320 at one side of the force receiving portions 32 receives the force, a biased turning of the safety gate 30 to one side takes place, the force receiving portion 32 is latched on the stopper 24 and cannot be moved towards the control dock 20. Furthermore, the ancillary stopper 321 of other force receiving portion 32 at another side that does not receive the force is engaged with another ancillary stopper 210 of the control dock 20 to increase the retaining force.

Figure 5:
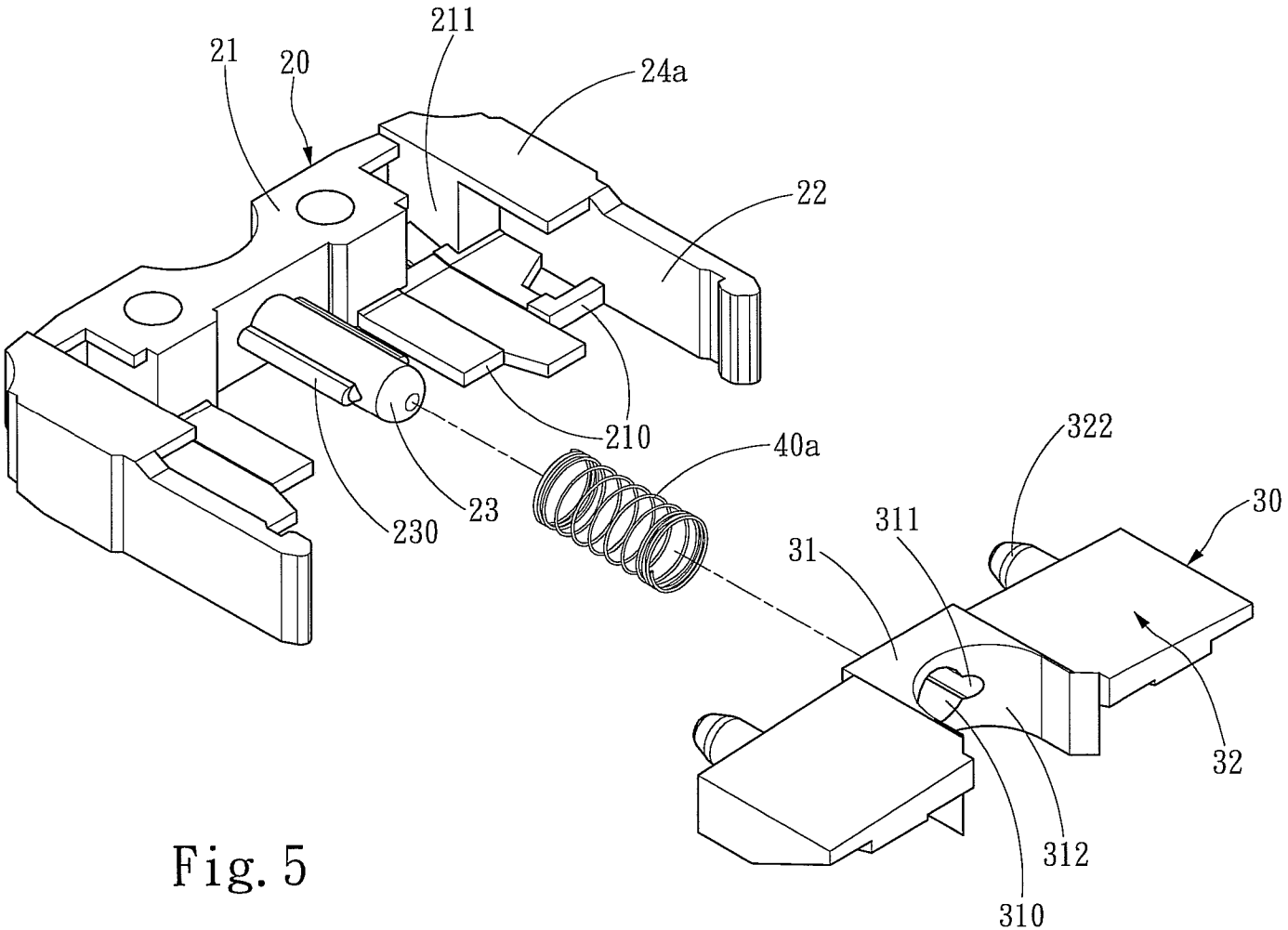
FIG. 5 is a schematic view of a second embodiment of the invention.
Figure 6:
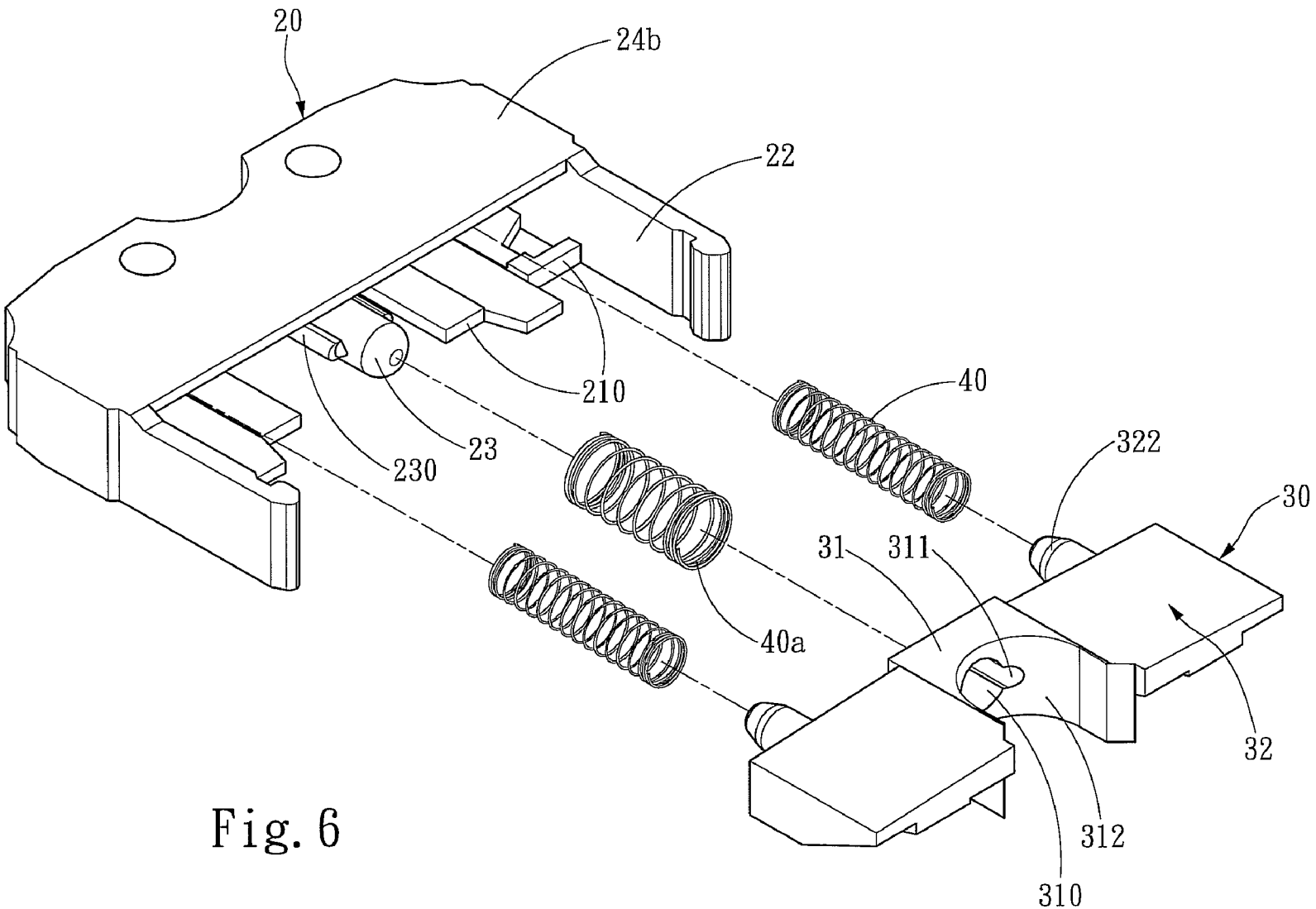
FIG. 6 is a schematic view of a third embodiment of the invention.
Figure 7:
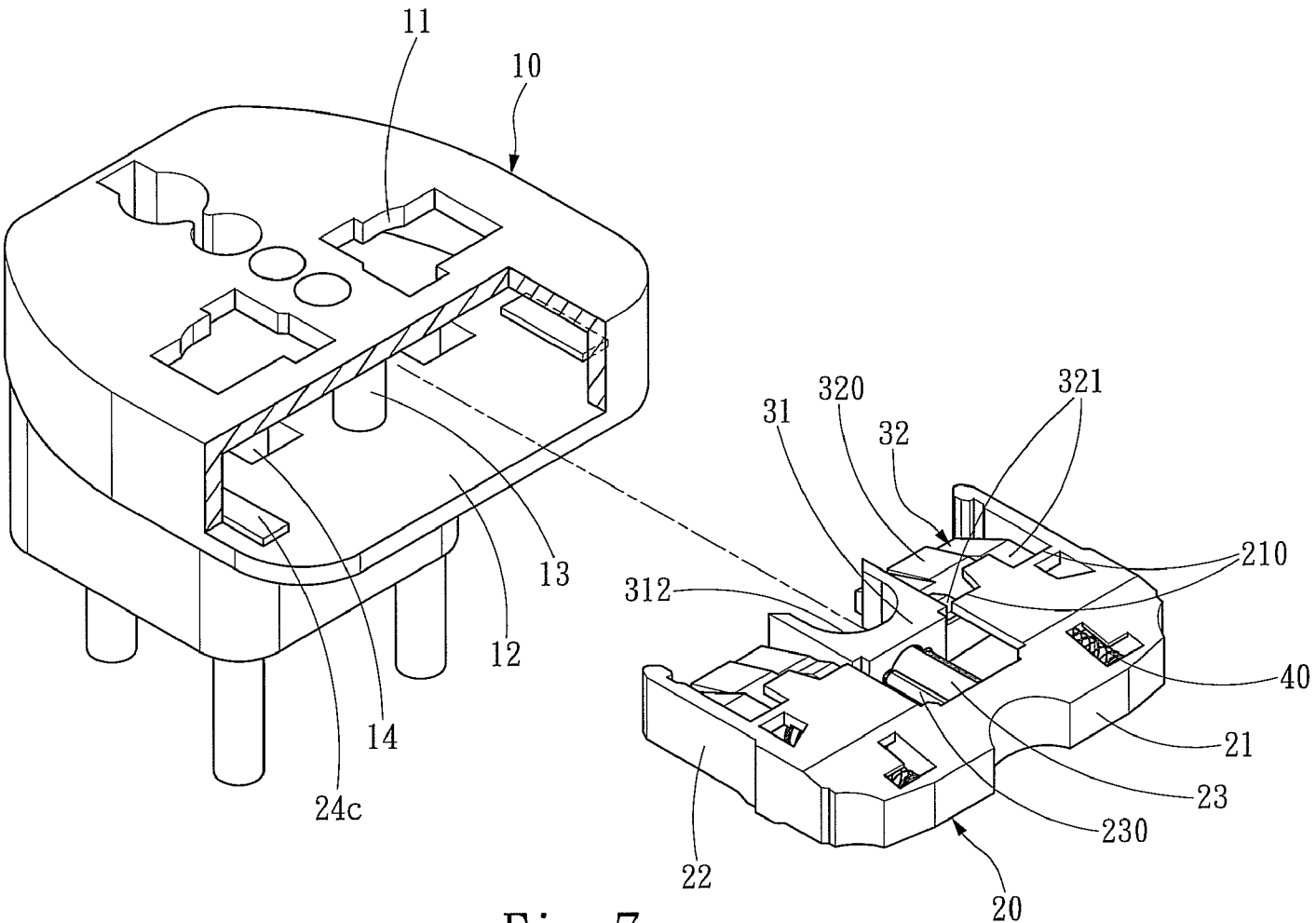
FIG. 7 is a schematic view of a fourth embodiment of the invention.

The stopper 24 of the invention, aside from being located at the bottom of the bracing arm 22, also can be an angular plate 24*a* located at the bottom of the control dock 20 and coupled with the base 21 and bracing arm 22 as shown in FIG. 5 with the elastic element 40*a* coupling on the directing stem 23; or as shown in FIG. 6, with the stopper 24*b* being a base plate located at the bottom of the control dock 20 coupling with the two bracing arms 22, and with the elastic elements 40 and 40*a* located respectively between the coupling strut 322 and the anchor notch 211 and on the directing stem 23 to increase elasticity. Moreover, referring to FIG. 7, the stopper 24*c* can also be a detent element located on the loading surface 12 of the power supply receptacle 10.

The present invention, by forming the stopper 24, 24*a*, 24*b* or 24*c* below the sliding path of the safety gate 30, when the force receiving portion 32 at one side of the safety gate 30 receives a force and causes the safety gate 30 turned in a biased manner, the force receiving portion 32 is latched on the stopper 24, 24*a*, 24*b* or 24*c*, thus the safety gate 30 cannot slide and remains at the latched position.

Based on the discussion set forth above it is obviously that the safety structure of the invention can provide enhanced safety for the power supply receptacle 10 and offer a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A sliding safety structure for power supply receptacles located on a path of a plug prong inserting to a receptacle electrode, comprising:

a control dock which is located on a loading surface formed in a power supply receptacle and has a directing stem; and a safety gate which is slidably located on the directing stem and has a sliding path and is pushed by one end of at least one elastic element interposed between thereof and the control dock so that the control dock is pushed by another end of the elastic element such that the safety gate is moved to a latched position in regular conditions; the safety gate also has two force receiving portions blocking the path of the plug prong at the latched position and inserted and propped up by the plug prong to force the safety gate to escape from the latched position when the plug prong is inserted into the power supply receptacle to connect the receptacle electrode; the safety gate further has a stopper below the sliding path to harness the safety gate to remain at the latched position when the two force receiving portions receive uneven forces.

2. The sliding safety structure of claim 1, wherein the control dock has a base and bracing arms at two sides of the base, and the directing stem is located on the base between the two bracing arms.

3. The sliding safety structure of claim 2, wherein the stopper is located at the bottom of the control dock.

4. The sliding safety structure of claim 3, wherein the stopper is a lug located at the bottom of the bracing arms.

5. The sliding safety structure of claim 3, wherein the stopper is an angular plate located at the bottom of the control dock coupling with the base and the bracing arms.

6. The sliding safety structure of claim 3, wherein the stopper is a base plate located at the bottom of the control dock coupling with the two bracing arms.

7. The sliding safety structure of claim 1, wherein the stopper is a detent element located on the loading surface of the power supply receptacle.

8. The sliding safety structure of claim 1, wherein the control dock and the force receiving portions have respectively an ancillary stopper above the sliding path of the safety gate that correspond to each other and form latched retaining with each other when one of the force receiving portions receives a force.

9. The sliding safety structure of claim 8, wherein the stopper and the ancillary stopper of the control dock are perpendicular to each other.

10. The sliding safety structure of claim 8, wherein the ancillary stopper of the force receiving portions is located at two sides thereof, and the ancillary stopper of the control dock is located at a position corresponding to the two sides of the force receiving portions.

11. The sliding safety structure of claim 1, wherein the safety gate has a sliding portion which has a directing hole slidably coupling on the directing stem.

12. The sliding safety structure of claim 11, wherein the directing stem and the directing hole have respectively a directing flange and a directing trough that correspond to each other.

13. The sliding safety structure of claim 12, wherein the directing stem is formed at a length greater than that of the directing flange.

14. The sliding safety structure of claim 11, wherein the sliding portion and the power supply receptacle have respectively a bracing surface and a bracing strut that are engageable with each other in regular conditions to keep the safety gate at the latched position.

15. The sliding safety structure of claim 1, wherein the elastic element has one end coupling with a coupling strut formed on the force receiving portions and the another end anchoring on an anchor notch formed on the control dock.

16. The sliding safety structure of claim 1, wherein the elastic element is coupled on the directing stem.

* * * * *